US010858764B2

(12) United States Patent
Hagl et al.

(10) Patent No.: US 10,858,764 B2
(45) Date of Patent: Dec. 8, 2020

(54) YARN RETURN UNIT FOR RETURNING A YARN AS WELL AS A WORKSTATION OF A TEXTILE MACHINE COMPRISING A YARN RETURN UNIT

(71) Applicant: Maschinenfabrik Rieter AG, Winterthur (CH)

(72) Inventors: Robert Hagl, Rottenegg (DE); Thomas Gruber, Ingolstadt (DE); Andreas Hoyer, Mainburg (DE); Bernd Bahlmann, Schrobenhausen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 51 days.

(21) Appl. No.: 16/170,082

(22) Filed: Oct. 25, 2018

(65) Prior Publication Data

US 2019/0119834 A1 Apr. 25, 2019

(30) Foreign Application Priority Data

Oct. 25, 2017 (DE) ..... 10 2017 124 989

(51) Int. Cl.
*D01H 1/115* (2006.01)
*B65H 51/16* (2006.01)
(Continued)

(52) U.S. Cl.
CPC ..... *D01H 1/115* (2013.01); *B65H 51/16* (2013.01); *B65H 67/081* (2013.01); *D01H 4/02* (2013.01);
(Continued)

(58) Field of Classification Search
CPC ..... D01H 4/48; D01H 4/50; D01H 15/00; D01H 15/02; B65H 69/061
(Continued)

(56) References Cited

U.S. PATENT DOCUMENTS 3,648,336 A * 3/1972 Bevington, Jr. ..... B65H 69/061 28/104
3,695,017 A 10/1972 Hori et al.
(Continued)

FOREIGN PATENT DOCUMENTS

DE 25 34 816 A1 2/1977
DE 37 04 829 A1 9/1987
(Continued)

OTHER PUBLICATIONS

Epo Search Report, dated Mar. 19, 2019.
German Patent Office Search Report, dated Aug. 28, 2018.

*Primary Examiner* — Shaun R Hurley
*Assistant Examiner* — Patrick J. Lynch
(74) *Attorney, Agent, or Firm* — Dority & Manning, P.A.

(57) ABSTRACT

A yarn return unit for returning a yarn into a delivery unit of a textile machine during a piecing process includes a yarn-guiding section configured to guide and position the yarn with respect to the delivery unit. A blowing unit generates an air flow for returning the yarn from the yarn-guiding section into the delivery unit, the blowing unit defining a flow direction of the air flow. The yarn-guiding section includes an open contour that defines an insertion area through which the yarn is inserted into the yarn-guiding section transversely to the flow direction of the air flow.

13 Claims, 4 Drawing Sheets

(51) Int. Cl.
*D01H 4/02* (2006.01)
*D01H 4/50* (2006.01)
*D01H 15/00* (2006.01)
*B65H 67/08* (2006.01)

(52) U.S. Cl.
CPC ..... *D01H 4/50* (2013.01); *D01H 15/002* (2013.01); *B65H 2701/31* (2013.01)

(58) Field of Classification Search
USPC ..... 57/263, 261
See application file for complete search history.

(56) References Cited

U.S. PATENT DOCUMENTS 4,083,171 A * 4/1978 Konig ..... D01H 4/48 57/263
4,408,442 A * 10/1983 Rohner ..... B65H 69/061 57/22
4,507,912 A * 4/1985 Noguchi ..... B65H 69/061 57/22
4,570,427 A * 2/1986 Premi ..... B65H 69/063 57/22
4,788,814 A * 12/1988 Crouch ..... B65H 69/061 57/22
5,379,581 A * 1/1995 Tobler ..... D01H 15/00 57/261
5,524,427 A * 6/1996 Sekiya ..... D01H 9/008 19/159 A
5,694,756 A * 12/1997 Lindner ..... D01H 4/50 57/263
5,877,434 A * 3/1999 Sturm ..... B65H 59/40 73/862.474
7,594,382 B2 9/2009 Weide et al.
2009/0094958 A1* 4/2009 Weide ..... D01H 1/115 57/263
2014/0283496 A1* 9/2014 Stahlecker ..... D01H 4/48 57/263

FOREIGN PATENT DOCUMENTS

DE 36 25 401 A1 2/1988
DE 10 2005 022 187 A1 11/2006
EP 2 042 625 A1 4/2009
GB 1 497 391 1/1978
JP 2001 159035 A 6/2001

* cited by examiner

YARN RETURN UNIT FOR RETURNING A YARN AS WELL AS A WORKSTATION OF A TEXTILE MACHINE COMPRISING A YARN RETURN UNIT

FIELD OF THE INVENTION

The present invention relates to a yarn return unit for returning a yarn into a delivery unit of a textile machine during a piecing process, in particular for returning a yarn into a spinning unit of an open-end spinning machine. The unit includes a yarn-guiding section for guiding and positioning the yarn with respect to the delivery unit, and a blowing unit for generating an air flow for returning the yarn into the delivery unit, wherein the blowing unit defines a flow direction of the air flow. Moreover, the invention comprises a workstation of a textile machine including a yarn return unit for returning a yarn into a delivery unit, in particular into a spinning position of an open-end spinning machine, during a piecing process.

BACKGROUND

DE 25 34 816 B2 describes a thread-guiding tube at a spinning position of an open-end spinning machine. The thread-guiding tube is fixedly situated at the spinning position and is designed as an annular ejector nozzle, with the aid of which the yarn can be returned into the spinning unit after an interruption of production. The disadvantage thereof is that, in the case of a thread break, for example, the thread must be threaded into the ejector nozzle, which is time-consuming and complex.

SUMMARY OF THE INVENTION

A problem addressed by the present invention is therefore that of eliminating the disadvantage of the related art. Additional objects and advantages of the invention will be set forth in part in the following description, or may be obvious from the description, or may be learned through practice of the invention.

The problem is solved by a yarn return unit and a workstation comprising a yarn return unit having the features set forth herein.

The invention relates to a yarn return unit for returning a yarn into a delivery unit of a textile machine during a piecing process. The delivery unit can be, for example, a spinning unit of an open-end spinning machine. The piecing process can be carried out, for example, when a yarn has broken in the textile machine and must be returned to the delivery unit, in particular, to the spinning unit, in order to enable the production process to be continued, for example.

The yarn return unit includes a yarn-guiding section for guiding and positioning the yarn with respect to the delivery unit. The yarn can be inserted in the yarn-guiding section, for example, so that the yarn is guided.

In addition, the yarn return unit includes a blowing unit for generating an air flow for returning the yarn into the delivery unit. The blowing unit defines a flow direction of the air flow in this case. The flow direction is designed in such a way that the flow direction is oriented toward the delivery unit when the yarn return unit is utilized as intended in the textile machine. The flow direction therefore extends essentially in a yarn transport direction of the produced yarn, but is opposite the draw-off or delivery direction of the yarn during production. With the aid of the air flow generated by the blowing unit, the yarn guided in the yarn-guiding section can be blown from the yarn return unit to the delivery unit.

According to the invention, the yarn return unit has an open contour including an insertion area, through which the yarn can be inserted into the yarn-guiding section transversely to the flow direction of the air flow. The yarn can be inserted into the yarn-guiding section through the open contour of the insertion area before being returned into the delivery unit, for example, during the drawing-open of a thread loop. When the yarn return unit is utilized as intended, the yarn can be inserted into the yarn-guiding section transversely to a yarn longitudinal direction and, therefore, also transversely to the yarn transport direction or essentially transversely to the flow direction. It is no longer necessary to thread the yarn, in its yarn longitudinal direction, through an opening into the yarn-guiding section.

In one advantageous refinement, the yarn-guiding section is a yarn-guiding channel. With the aid of the yarn-guiding channel, the yarn can be guided in the yarn longitudinal direction across a longer area. Alternatively, the yarn-guiding section can also be designed as a yarn-guiding ring. As a result, the yarn return unit can be designed to be more space-efficient. Alternatively, the yarn return unit can also include several yarn-guiding channels or yarn-guiding rings. If the yarn-guiding section is a yarn-guiding channel, it is furthermore advantageous when the insertion area is designed as an insertion slot oriented in the flow direction of the air flow, in order to facilitate the insertion of the yarn.

It is advantageous when the yarn return unit includes a cutting section which is spaced apart from the yarn-guiding section and has a cutting unit, with the aid of which the yarn can be cut in two. With the aid of the cutting unit, a defined yarn end can be formed when, for example, the yarn in a spinning unit is retrieved from a bobbin and is returned to the spinning unit for the piecing process. In this case, the cutting section can be preferably situated so as to be spaced apart from the yarn-guiding section in a direction transversely to the flow direction of the air flow. As a result, when the yarn return unit is utilized as intended, the cutting section is spaced apart from the yarn-guiding section in the yarn transverse direction. For example, a feeder unit, which retrieves, from the bobbin, the yarn wound onto the bobbin in order to be pieced at the delivery unit, can form a yarn loop, wherein one of the two legs of the yarn loop is inserted into the cutting section and the other leg of the yarn loop is inserted into the yarn-guiding section. In this case, the yarn moving from the bobbin to the delivery unit is advantageously inserted into the yarn-guiding section and the yarn moving away from the delivery unit is advantageously inserted into the cutting section.

It is advantageous when the yarn-guiding section has a circular, elliptical, and/or angular cross-section. Additionally or alternatively, the cutting section can also have a circular, elliptical, and/or angular cross-section. As a result, the yarn can be well guided.

It is also advantageous when the cutting section includes an insertion section, through which the yarn can be inserted into the cutting section. The insertion section can be slot-shaped, similarly to the insertion area of the yarn-guiding section. The insertion section is preferably oriented in parallel to the open contour of the insertion area or the insertion slot, although the insertion section can also extend at an angle thereto. The open contour can be, for example, a slot-shaped recess, through which the yarn can be inserted. As a result, the yarn can be inserted into the cutting section transversely to the yarn longitudinal direction and no longer needs to be threaded into the cutting section in its yarn longitudinal direction.

It is advantageous when the insertion area includes at least one insertion surface. Additionally or alternatively, the insertion section can also include at least one insertion surface. The yarn can be inserted into the insertion area with the aid of the insertion surface. Additionally or alternatively, the yarn can be inserted into the insertion section with the aid of the insertion surface. The insertion surface can be slanted, for example, toward the insertion area or toward the insertion section, and so the yarn slides down the insertion surface into the insertion area or into the insertion section.

It is advantageous when the blowing unit is designed to be annular and at least partially encloses the yarn-guiding section. As a result, the blowing unit can form the air flow which draws the yarn along in a central area of the air flow. The blowing unit includes a recess, through which the yarn can be inserted into the blowing unit and into the yarn-guiding section. By way of the recess, the yarn can be introduced into the annular blowing unit. Therefore, the yarn does not need to be threaded into the blowing unit, via one yarn end, in the air flow direction.

It is advantageous when the blowing unit is formed by an insert which can be inserted into the yarn return unit. The blowing unit can therefore be retrofitted. In addition, a suitable insert can be inserted into the blowing unit for each application and for each type of yarn.

It is advantageous when the yarn return unit includes at least one measuring unit, with the aid of which a presence of the yarn in the yarn return unit can be established. In this case, it can be established, for example, whether the yarn is situated in the yarn-guiding section and/or in the cutting section. The measuring unit can include, for example, a light barrier that can establish whether the yarn is situated in the yarn-guiding section and/or in the cutting section. Additionally or alternatively, yarn properties can also be established with the aid of the measuring unit. The measuring unit can include, for example, a microwave sensor, with the aid of which, for example, a yarn thickness can be measured, on the basis of which a quality of the yarn can be inferred.

It is advantageous when the yarn return unit is connected to a traversing device for traversing the yarn with respect to a pair of delivery rollers of the workstation. As a result, the yarn return unit can be traversed as well, so that the yarn return unit does not obstruct the traversing yarn. As a result, in addition, no additional thread-guiding element is required between the yarn return unit and the traversing device and/or a measuring unit which is also traversing. In addition, due to the combination of the yarn return unit with the traversing device and, if necessary, also the measuring unit, a highly compact unit can be created, which can be situated on the textile machine in a space-saving manner.

The invention also relates to a workstation of a textile machine that includes a yarn return unit for returning a yarn into a delivery unit during a piecing process. The delivery unit can be, for example, a spinning position in an open-end spinning machine, and so the yarn can be returned into the spinning position to be pieced again.

According to the invention, the yarn return unit is designed according to at least one feature of the preceding description.

In one advantageous refinement of the invention, the workstation comprises a traversing device for traversing the yarn with respect to a pair of delivery rollers of the workstation. Moreover, the yarn return unit is connected to the traversing device, so that the yarn return unit can be traversed as well. With the aid of the traversing device, the yarn can be moved laterally to and fro, in order to thereby reduce, for example, wear of one of the pairs of delivery rollers positioned downstream from the traversing device. If the yarn return unit traverses together with the traversing device, the yarn return unit does not obstruct the traversing movement of the yarn.

It is advantageous when the workstation comprises a feeder unit that is movably situated at the workstation, with the aid of which the yarn can be picked up and inserted into the yarn-guiding section of the yarn return unit. The feeder unit can be, for example, a pivotable arm situated at the workstation, which picks up the yarn from a bobbin, onto which the yarn has been wound, due to a yarn break, with the aid of an eyelet or yarn guide situated on the arm. With the aid of a feed movement, in particular, a pivoting, of the feeder unit, the yarn end can be brought to the delivery unit to be pieced again. As a result, there is no need to manually bring the yarn to the delivery unit.

The delivery unit can comprise an injector nozzle so that the yarn can be sucked into the delivery unit. A low pressure, for example, can be generated with the aid of the injector nozzle, and so the yarn can be sucked into the injector nozzle. Alternatively, the injector nozzle can also generate a flow which blows the yarn or a free yarn end in the direction of the delivery unit.

BRIEF DESCRIPTION OF THE DRAWINGS

Further advantages of the invention are described in the following exemplary embodiments. Wherein.

DETAILED DESCRIPTION

Figure 1:
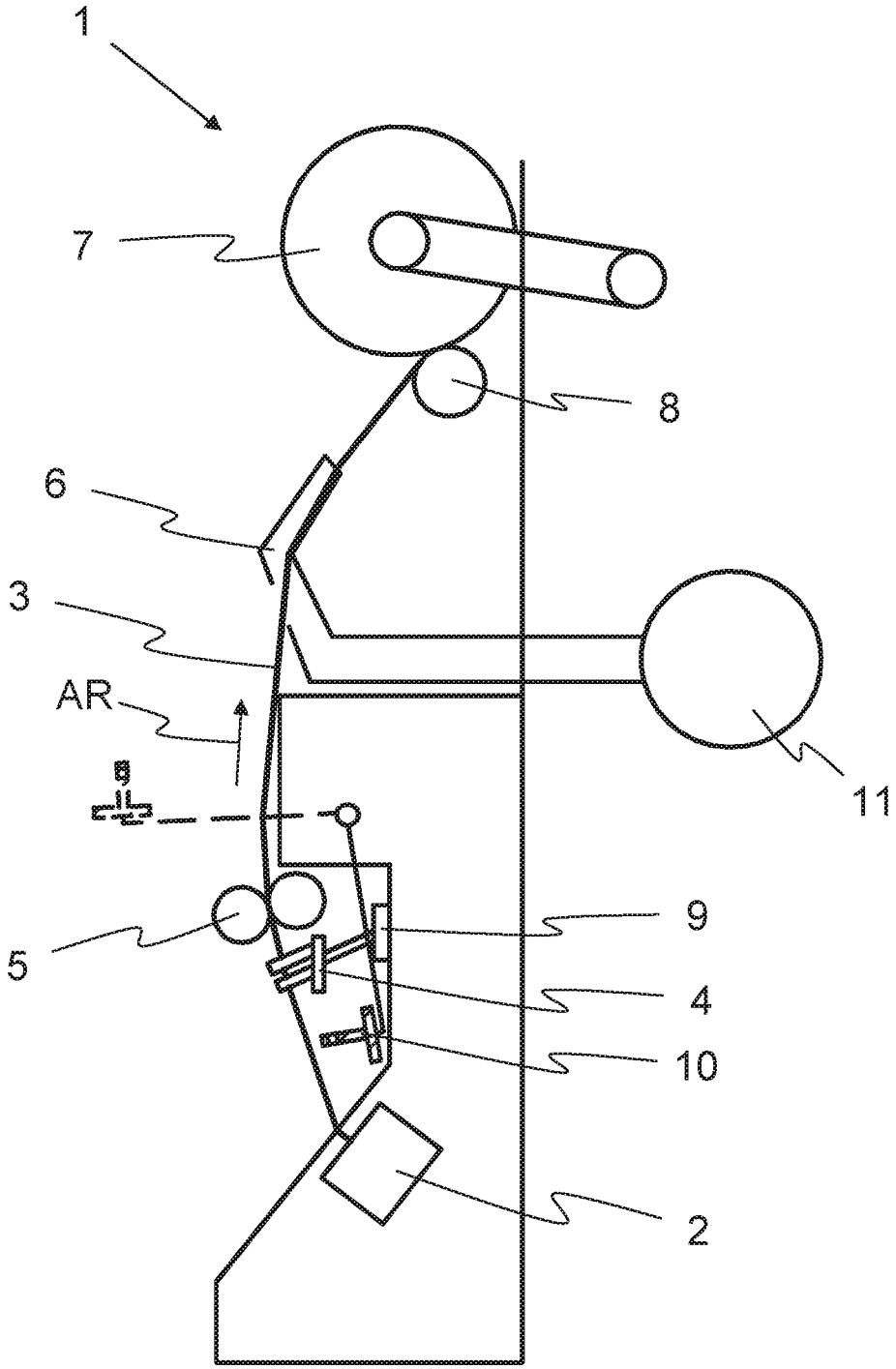
FIG. 1 shows a schematic side view of a workstation of a textile machine comprising a yarn-delivering delivery unit, a yarn return unit, and a bobbin.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a workstation 1 of a textile machine. In the workstation 1, a yarn 3 can be delivered by a delivery unit 2. The workstation 1 can be, for example, a spinning position, wherein the delivery unit 2 is a spinning unit which spins the yarn 3 from individual fibers. The yarn 3 is delivered by the delivery unit 2 in a delivery direction or draw-off direction AR and, according to the present example, is drawn out of the delivery unit 2 with the aid of a pair of delivery rollers 5.

A yarn return unit 4 is positioned downstream from the delivery unit 2 in the delivery direction AR. The pair of delivery rollers 5 is positioned downstream from the yarn return unit 4. From the pair of delivery rollers 5, the yarn 3 travels to a bobbin 7, onto which the yarn 3 is wound according to the present exemplary embodiment. The bobbin 7 is driven by a winding roller 8 in this case.

According to the present exemplary embodiment from FIG. 1, a suction tube 6 can be situated between the pair of draw-off rollers 5 and the bobbin 7; a vacuum can be applied to the suction tube 6 by a suction unit 11. In the case of a yarn break, a yarn end wound onto the bobbin 7 can be sought and picked up with the aid of the suction tube 6.

The workstation 1 furthermore comprises a feeder unit 10, with the aid of which the broken yarn 3 can be retrieved from the bobbin 7 or the suction tube 6 and brought back to the delivery unit 2. According to the present exemplary embodiment, the feeder unit 10 can be pivoted toward the suction tube 6 through the position shown here with the aid of dashed lines, in order to retrieve the yarn 3. Upon bringing the yarn 3 back, the feeder unit 10 can also insert the yarn 3 back into the yarn return unit 4. The feeder unit 10 forms a loop 36 (see FIG. 2*b*) from the yarn 3 in this case.

According to the present exemplary embodiment, the yarn return unit 4 is situated at a traversing device 9 and is connected thereto, and so the yarn return unit 4 can also be traversed as well. As a result, the yarn return unit 4 does not obstruct the yarn 3 when the yarn 3 traverses.

Figure 2A:
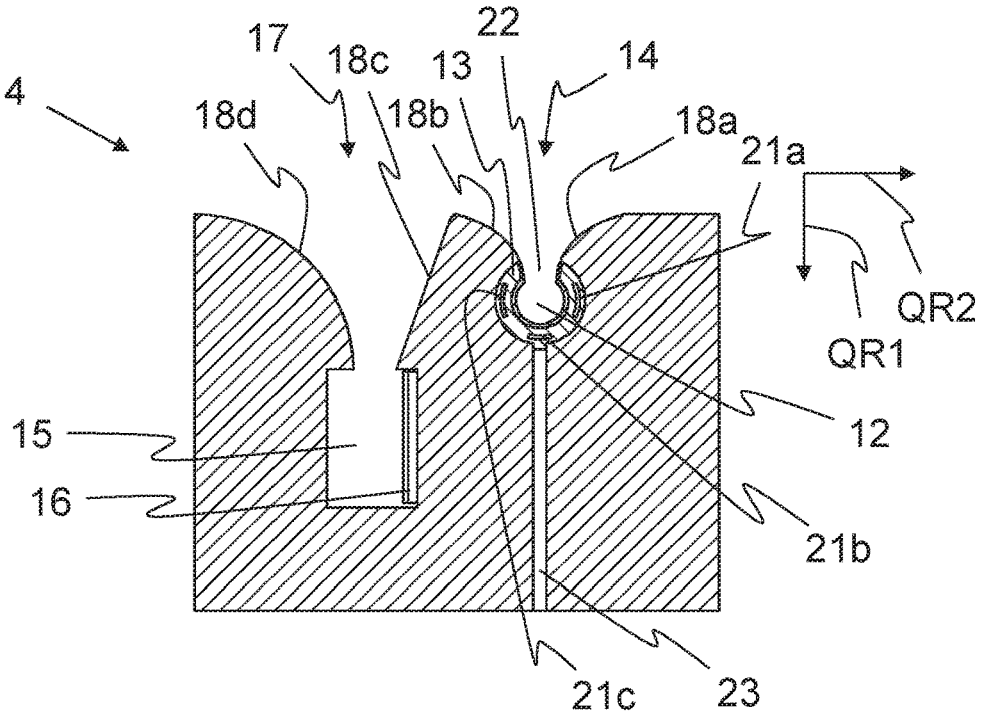
FIG. 2*a* shows a cutaway view of a top view of a yarn return unit including a yarn-guiding section and a cutting section.

FIG. 2*a* shows a cutaway view of a top view of the yarn return unit 4 including a yarn-guiding section 12 and a cutting section 15. The yarn 3 situated between the delivery unit 2 and the pair of draw-off rollers 5 can be guided with the aid of the yarn-guiding section 12. In particular, the yarn 3 can be guided with the aid of the yarn-guiding section 12 in order to return the yarn 3 into the delivery unit 2 during a piecing process.

The return of the yarn 3 can be necessary, for example, when the yarn 3 has broken during the delivery by the delivery unit 2. After the yarn break, the yarn 3 has been wound onto the bobbin 7 and must be returned to the delivery unit 2 for piecing. The return can be carried out, at least partially, by the feeder unit 10 which can form a loop 36 (see FIG. 2*b*) in the yarn 3 and draw this loop 36 to the delivery unit 2. In addition, the feeder unit 10 tightens the yarn 3. One leg 37 of the loop can be inserted into the yarn-guiding section 12, as is explained in greater detail in the following with reference to FIG. 2*b*. In order to enable the yarn 3 to be inserted into the yarn-guiding section 12, the yarn-guiding section 12 includes an insertion area 14. The yarn-guiding section 12 has, with the insertion area 14, an open contour, by way of which the yarn 3 can be inserted through the insertion area 14 into the yarn-guiding section 12 transversely to a longitudinal direction LR (see FIG. 2*b*) of the yarn-guiding section 12. The tightened yarn 3 can be inserted into the yarn-guiding section 12, through the insertion area 14, in a transverse direction QR1 oriented transversely to the longitudinal direction LR of the yarn-guiding section 12.

The yarn return unit 4 furthermore comprises a blowing unit 13 which can form an air flow 19 (cf. FIG. 2*b*) in a flow direction SR. The flow direction SR is oriented in parallel to the longitudinal direction LR of the yarn-guiding section 12 in this case. The yarn 3 is therefore inserted into the yarn-guiding section 12 transversely to the flow direction SR of the air flow 19 of the blowing unit 13.

The blowing unit 13 can be designed, for example, as an insert which can be inserted into the yarn return unit 4. According to the present exemplary embodiment, the blowing unit 13 can be designed to be annular, wherein the blowing unit 13 includes a recess 22 for inserting the yarn 3, through the recess 22, into an area within the blowing unit 13 and, therefore, into the yarn-guiding section 12.

The blowing unit 13 can furthermore comprise at least one flow channel 21*a-c*, with the aid of which the air flow 19 can be formed. In the present case, the blowing unit 13 comprises three flow channels 21*a-c* which are arranged in the blowing unit 13 in such a way that they are situated around the yarn-guiding section 12. The orientation of the flow channels 21*a-c* essentially defines the flow direction SR of the air flow 19.

Moreover, the yarn return unit 4 comprises a compressed air channel 23, with the aid of which the blowing unit 13 can be supplied with compressed air for forming the air flow 19.

The insertion area 14 of the yarn-guiding section 12 can furthermore comprise at least one insertion surface 18*a, b*, with the aid of which the yarn 3 can be guided into the yarn-guiding section 12. According to the present exemplary embodiment, the insertion area 14 comprises two insertion surfaces 18*a, b*, wherein one insertion surface 18*a, b* is situated on each side of the yarn-guiding section 12. As a result, the yarn 3 can be guided into the yarn-guiding section 12 from either side. The yarn 3 can slide down the insertion surfaces 18*a, b* in order to enter the yarn-guiding section 12.

According to the present exemplary embodiment, the yarn return unit 4 also comprises a cutting section 15 which is spaced apart from the yarn-guiding section 12 in the second transverse direction QR2. The second transverse direction QR2 is oriented transversely to the longitudinal direction LR of the yarn-guiding section 12 and transversely to the flow direction SR of the air flow 19. A cutting unit 16, which can cut the yarn 3 situated in the cutting section 15, is situated in the cutting section 15. The cutting section 15 includes an insertion section 17 for enabling the yarn 3 to be inserted into the cutting section 15.

The insertion section 17 can also comprise at least one insertion surface 18*c, d*. The two insertion surfaces 18*c, d* are situated at the cutting section 15, one on each side. With the aid of the insertion surfaces 18*c, d*, the yarn 3 can be guided into the cutting section 15 in this case as well. The yarn 3 can slide down the insertion surfaces 18*c, d* in this case, since the insertion surfaces 18*c, d* are slanted in the direction of the insertion section 15.

Figure 2B:
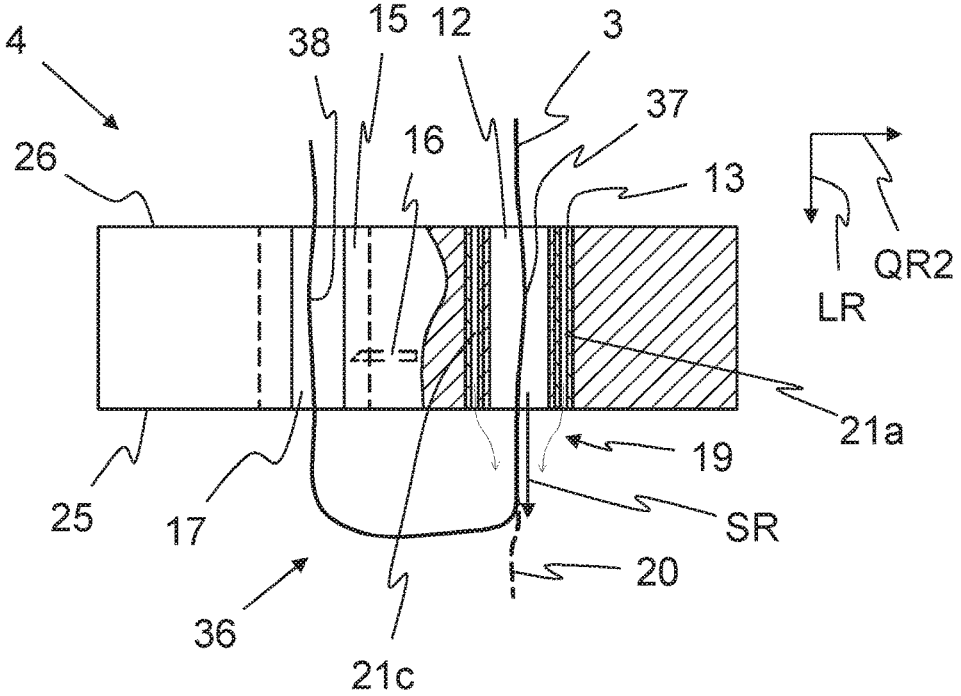
FIG. 2*b* shows a front view of the yarn return unit from FIG. 2*a;*

FIG. 2*b* shows a front view of the yarn return unit 4. According to the present exemplary embodiment, the yarn-guiding section 12 is designed as a yarn-guiding channel which extends in the flow direction SR of the air flow 19. The yarn-guiding section 4 can define the longitudinal direction LR in this case. The air flow 19 can be formed by the blowing unit 13. The air flow 19 defines the flow direction SR. The flow direction SR is oriented in parallel to the longitudinal direction LR of the yarn-guiding section 12. The second transverse direction QR2 is oriented transversely to the flow direction SR.

Moreover, the yarn 3 is situated in the yarn-guiding section 12. The yarn 3 furthermore extends through the cutting section 15 of the yarn return unit 4. FIG. 2*b* shows, for example, the state when the yarn 3 has broken and has been wound onto the bobbin 7. The feeder unit 10 has drawn the yarn 3 from the bobbin 7 and brought it in the direction of the delivery unit 2. The yarn 3 forms a loop 36, wherein a first leg 37 of the loop 36 of the yarn 3 is situated in the yarn-guiding section 12 and a second leg 38 of the loop 36 is situated in the cutting section 15. Due to the fact that the yarn-guiding section 12 includes the insertion area 14, the yarn 3 can be inserted into the yarn-guiding section 12 through the insertion area 14 even when the yarn 3 is extended in the flow direction SR. The yarn 3 does not need to be threaded into the yarn-guiding section 12, in the flow direction SR, from one direction. The feeder unit 10 can insert the yarn 3 into the yarn-guiding section 12 in the first transverse direction QR1. The insertion of the yarn 3 is facilitated as a result. The yarn-guiding section 12 has a slot-shaped, open contour in this case, which can form the insertion area 14.

After the yarn 3 has been inserted into the yarn-guiding section 12 and the cutting section 15, the yarn 3 can be cut in the cutting section 15 with the aid of the cutting unit 16. As a result, a defined free yarn end 20 of the yarn 3 can be formed. The cut yarn 3 including the free yarn end 20 is shown as a dashed line according to FIG. 2*b*. The free yarn end 20 can be blown with the aid of the air flow 19 to the delivery unit 2, in which piecing, for example, spinning, can be carried out on the free yarn end 20.

The two flow channels 21*a, c* are shown in FIG. 2*b*. The flow channels 21*a, c* extend completely through the yarn return unit 4 in the longitudinal direction LR. The air flow 19 therefore emerges from the blowing unit 13 on an underside 25 of the yarn return unit 4, laterally spaced apart from the yarn-guiding section 12. The underside 25 can face the delivery unit 2. The air flow 19 therefore first has contact with the yarn 3 beyond the underside 25 in the flow direction SR.

Figure 3:
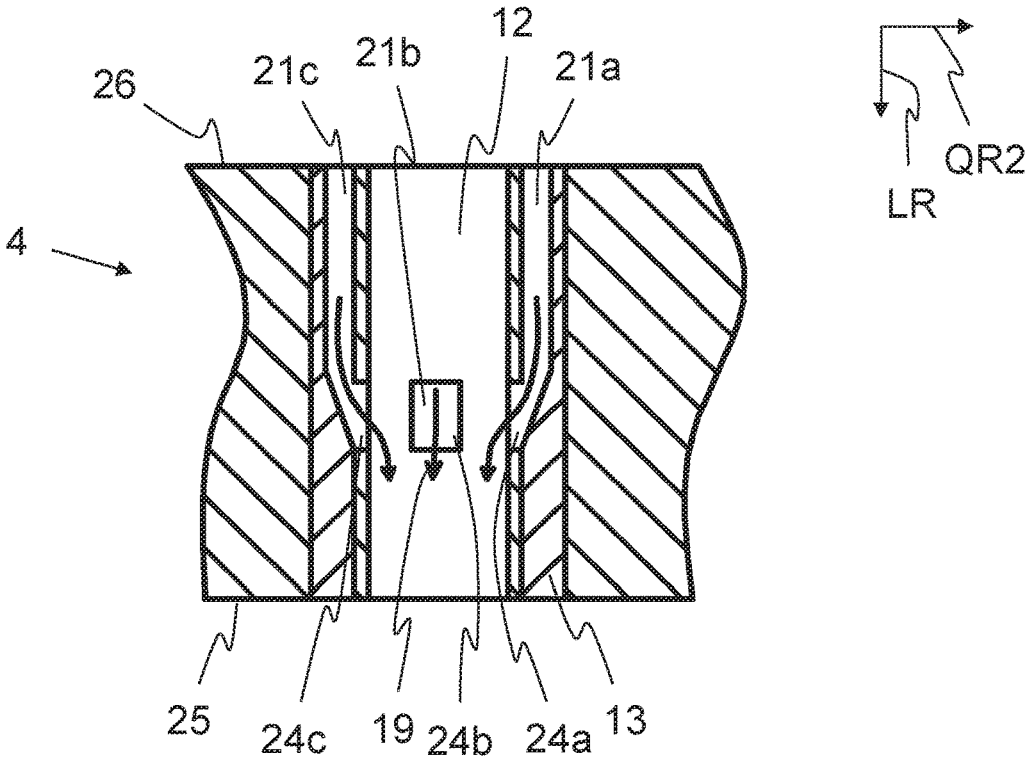
FIG. 3 shows a cutaway view of the area of the yarn-guiding section comprising a blowing unit which introduces an air flow into the yarn-guiding section in one area.

FIG. 3 shows a section of one further exemplary embodiment of the yarn return unit 4 comprising the yarn-guiding section 12 and a blowing unit 13. The yarn return unit 4 is shown here in a cutaway view. According to FIG. 3, the blowing unit 13 is represented in an alternative exemplary embodiment. In this case as well, the blowing unit 13 is designed as an insertable insert which extends completely through the yarn return unit 4 in the longitudinal direction LR.

The flow channels 21*a-c* of the blowing unit 13 extend through the yarn return unit 4 partially in the longitudinal direction LR in this case. The air flow 19 in the flow channels 21*a-c* enters the yarn-guiding section 12 at exit openings 24*a-c* from the blowing unit 13. A separate exit opening 24*a-c* is assigned to each flow channel 21*a-c*. As a result, the air flow 19 still flows partially in the yarn-guiding section 12 and can draw the yarn 3 (not shown here) along with it. As a result, the yarn 3 can be better guided.

Figure 4:
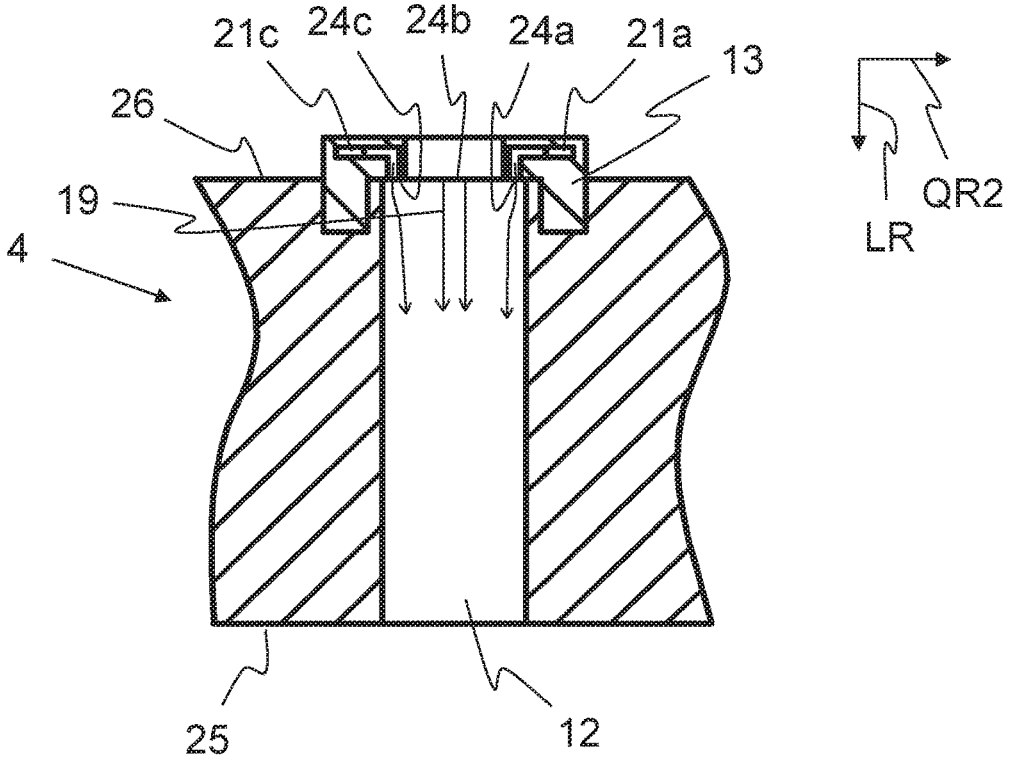
FIG. 4 shows a cutaway view of the area of the yarn-guiding section comprising a blowing unit which introduces an air flow into the yarn-guiding section from a top side.

FIG. 4 shows a section of one further exemplary embodiment of the yarn return unit 4 comprising the yarn-guiding section 12 and a blowing unit 13. The blowing unit 13 is designed as an insert in this case as well. According to the present exemplary embodiment, the blowing unit 13 is situated in an area on a top side 26 of the yarn return unit 4. The blowing unit 13 comprises the flow channels 21*a-c* which introduce the air flow 19 on the top side 26 into the yarn-guiding section 12. The top side 26 can face the pair of delivery rollers 5. The flow channels 21*a-c* comprise exit openings 24*a-c* which are oriented in the direction of the underside 25. The air flow 19 is formed as a result, the flow direction SR of which extends in the longitudinal direction LR toward the yarn-guiding section 12. Due to the blowing unit 13 from FIG. 4, the air flow 19 flows through the entire yarn-guiding section 12, and so the yarn 3, which is situated therein and is not shown here, can be guided.

Figure 5:
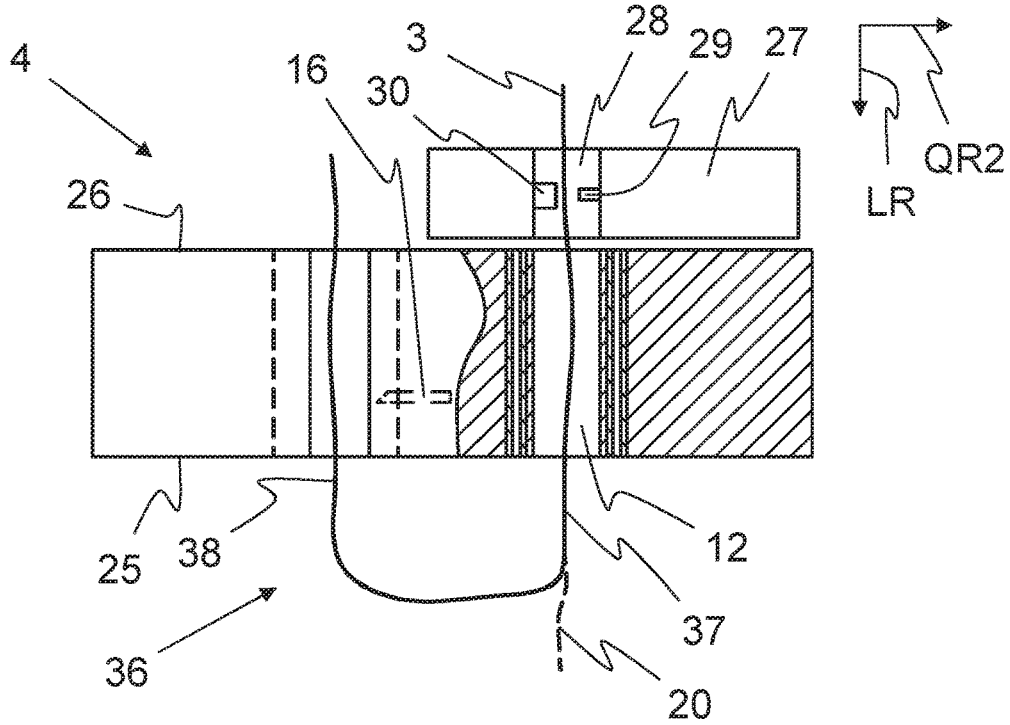
FIG. 5 shows a partial cutaway view of a yarn return unit comprising a measuring unit.

FIG. 5 shows a partial cutaway view of a yarn return unit 4 comprising a measuring unit 27. A measuring unit 27, with the aid of which yarn properties and/or the presence of the yarn 3 can be registered, can be situated ahead of the top side 26 in the longitudinal direction LR.

In the present exemplary embodiment, the measuring unit 27 includes a measuring section 28, through which the yarn 3 can be guided in order to be measured. A sensor unit, which comprises a transmission element 29 and a sensor element 30 in the present exemplary embodiment, can be situated in the measuring section 28. The sensor unit can comprise a light barrier, for example, wherein, in this case, the transmission element 29 is a light source and the sensor element 30 is, for example, a light detector. The presence of the yarn 3 can be sensed with the aid of the sensor unit. Additionally or alternatively, the yarn properties, for example, a hairiness and/or a yarn thickness, can be ascertained.

Additionally or alternatively, it can also be detected, with the aid of one further measuring unit 27 or with the aid of one further sensor unit on the measuring unit 27, whether the yarn 3 is located in the cutting section 15.

Figure 6:
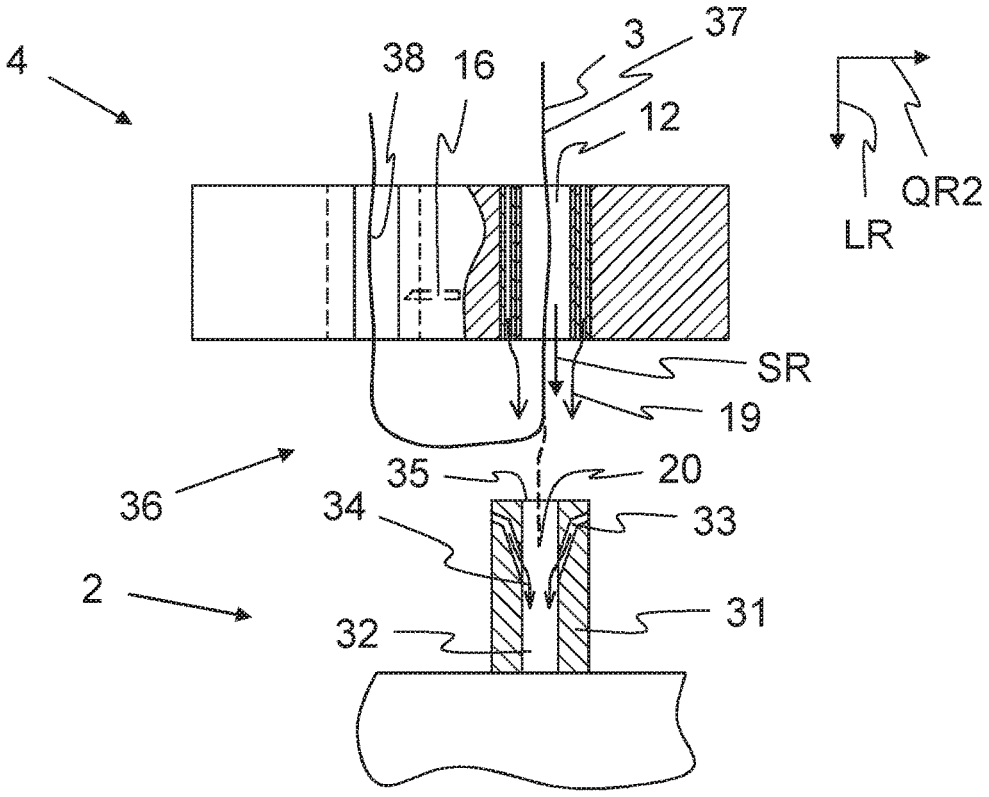
FIG. 6 shows a schematic, partial cutaway view of the yarn return unit and the delivery unit.

FIG. 6 shows a schematic view of the yarn return unit 4 and the delivery unit 2. The delivery unit 2 is shown only in part in this case. In this exemplary embodiment, an injector nozzle 31 is situated at the delivery unit 2, which can suck the yarn end 20, in particular, into the delivery unit 2, and so piecing, for example, spinning can be carried out thereon again.

The injector nozzle 31 is advantageously situated in the alignment direction with respect to the yarn-guiding section 12 of the yarn return unit 4 when the yarn end 20 is to be sucked in. The air flow 19 has a flow direction SR in this case, which extends through a nozzle opening 35 of the injector nozzle 31, and so the yarn 3 is guided into a nozzle channel 32. As a result, the yarn end 20 is guided into the injector nozzle 31 with the aid of the air flow 19.

The injector nozzle 31 can comprise a vacuum system 33 which directs a suction flow 34 into the nozzle channel 32. As a result, a vacuum is generated at the nozzle opening 35 of the injector nozzle 31 facing the yarn return unit 4, and so the yarn end 20 can be sucked in and conveyed into the delivery unit 2.

The present invention is not limited to the exemplary embodiments which have been represented and described. Modifications within the scope of the claims are also possible, as is any combination of the features, even if they are represented and described in different exemplary embodiments.

LIST OF REFERENCE SIGNS

1 workstation
2 delivery unit
3 yarn
4 yarn return unit
5 pair of delivery rollers
6 suction tube
7 bobbin
8 winding roller
9 traversing device
10 feeder unit
11 suction unit
12 yarn-guiding section
13 blowing unit
14 insertion area
15 cutting section

16 cutting unit
17 insertion section
18 insertion surface
19 air flow
20 free yarn end
21 flow channel
22 recess
23 compressed air channel
24 exit opening
25 underside
26 top side
27 measuring unit
28 measuring section
29 transmission element
30 sensor element
31 injector nozzle
32 nozzle channel
33 vacuum system
34 suction flow
35 nozzle opening
36 loop
37 first leg
38 second leg
AR delivery direction
QR1 first transverse direction
QR2 second transverse direction
LR longitudinal direction
SR flow direction

The invention claimed is:

1. A yarn return unit for returning a yarn into a delivery unit of an individual workstation of a textile machine during a piecing process, comprising:

a yarn-guiding section configured to guide and position the yarn with respect to the delivery unit;

a blowing unit configured to generate an air flow for returning the yarn from the yarn-guiding section into the delivery unit, the blowing unit defining a flow direction of the air flow longitudinally through the yarn-guiding section towards the delivery unit;

the yarn-guiding section comprising an open contour that defines an insertion area through which the yarn is inserted into the yarn-guiding section transversely to the flow direction of the air flow;

a cutting section in the yarn return unit extending alongside the yarn-guiding section and spaced from the yarn guiding section in a direction transverse to the flow direction of the air flow, the cutting section comprising a cutting unit, wherein for the piecing process after a yarn break, the yarn can form a bop having a first leg in the yarn-guiding section and a second leg in the cutting section;

the yarn return unit mountable at a fixed location on the individual workstation of the textile machine between the delivery unit and a pair of delivery rollers; and the yarn-guiding section configured to align with the delivery unit along the flow direction of the air such that a free end of the yarn formed after cutting the second leg in the cutting section is delivered directly by the air flow into the delivery unit.

2. The yarn return unit as in claim 1, wherein the yarn-guiding section comprises a yarn-guiding channel or a yarn-guiding ring, and the insertion area comprises an insertion slot oriented in the flow direction of the air flow.

3. The yarn return unit as in claim 1, wherein one or both of the yarn-guiding section and the cutting section comprises one of a circular, elliptical, or angular cross-section.

4. The yarn return unit as in claim 1, wherein the cutting section comprises a slot-shaped insertion section through which the yarn is inserted into the cutting section.

5. The yarn return unit as in claim 4, wherein one or both of the insertion area and the insertion section comprises an insertion surface to aid insertion of the yarn therein.

6. The yarn return unit as in claim 1, wherein the blowing unit is annular and at least partially encloses the yarn-guiding section, the blowing unit comprising a recess through which the yarn is inserted into the blowing unit and into the yarn-guiding section.

7. The yarn return unit as in claim 6, wherein the blowing unit is formed by an insert that is inserted into the yarn return unit.

8. The yarn return unit as in claim 1, further comprising a measuring unit disposed to detect presence of the yarn in the yarn return unit or to detect properties of the yarn running through the yarn return unit.

9. The yarn return unit as in claim 1, wherein the yarn return unit is connected to a traversing device that traverses the yarn with respect to the pair of delivery rollers of the individual workstation.

10. A workstation of a textile machine, comprising the yarn return unit in accordance with claim 1 for returning the yarn into the delivery unit during a piecing process.

11. The workstation as in claim 10, further comprising a pair of delivery rollers and a traversing device that traverses the yarn with respect to the pair of delivery rollers, the yarn return unit connected to the traversing device.

12. The workstation as in claim 10, further comprising a feeder unit configured to pick-up and insert the yarn into the yarn-guiding section of the yarn return unit.

13. The workstation as in claim 10, wherein the delivery unit comprises an injector nozzle configured to suck the yarn into the delivery unit.

* * * * *